US010706759B2

(12) United States Patent
Wang et al.

(10) Patent No.: US 10,706,759 B2
(45) Date of Patent: Jul. 7, 2020

(54) CURRENT COMPARISON CIRCUIT, DISPLAY DEVICE AND DRIVING METHOD THEREOF

(71) Applicants: BOE Technology Group Co., Ltd., Beijing (CN); Ordos Yuansheng Optoelectronics Co., Ltd., Ordos, Inner Mongolia (CN)

(72) Inventors: Yaran Wang, Beijing (CN); Wei Zhang, Beijing (CN); Jigang Sun, Beijing (CN); Wei Sun, Beijing (CN)

(73) Assignees: BOE TECHNOLOGY GROUP CO., LTD., Beijing (CN); ORDOS YUANSHENG OPTOELECTRONICS CO., LTD., Ordon, Inner Mongolia (CN)

( * ) Notice: Subject to any disclaimer, the term of this patent is extended or adjusted under 35 U.S.C. 154(b) by 105 days.

(21) Appl. No.: 16/096,607

(22) PCT Filed: May 15, 2018

(86) PCT No.: PCT/CN2018/086807
§ 371 (c)(1),
(2) Date: Oct. 25, 2018

(87) PCT Pub. No.: WO2018/233402
PCT Pub. Date: Dec. 27, 2018

(65) Prior Publication Data

US 2020/0005695 A1 Jan. 2, 2020

(30) Foreign Application Priority Data

Jun. 19, 2017 (CN) ..... 2017 1 0463360

(51) Int. Cl.
*G09G 3/20* (2006.01)

(52) U.S. Cl.
CPC ..... *G09G 3/20* (2013.01); *G09G 2310/0243* (2013.01); *G09G 2330/021* (2013.01)

(58) Field of Classification Search
None
See application file for complete search history.

(56) References Cited

U.S. PATENT DOCUMENTS 6,714,473 B1 3/2004 Fiscus
2008/0049006 A1 2/2008 Yi et al.
(Continued)

FOREIGN PATENT DOCUMENTS

CN 1610947 A 4/2005
CN 1801394 A 7/2006
(Continued)

OTHER PUBLICATIONS

English machine translation of Chinese patent publication CN 105405425 (Year: 2016).*
(Continued)

*Primary Examiner* — Nicholas J Lee
(74) *Attorney, Agent, or Firm* — Myers Bigel, P.A.

(57) ABSTRACT

A current comparison circuit for use in a display device. The display device is configured to be supplied with a plurality of power supply voltages for powering a digital portion and an analog portion of the display device through respective power supplying paths. The current comparison circuit includes a plurality of comparator circuits, each of which is configured to compare a current on a respective one of the power supplying paths with a respective reference value and to output the respective comparison value. A combination of the respective comparison values output by the comparator circuits indicates a type of content being displayed by the display device.

20 Claims, 3 Drawing Sheets

(56) References Cited

U.S. PATENT DOCUMENTS

| | | | |
|---|---|---|---|
| 2009/0046083 | A1 | 2/2009 | Kim et al. |
| 2011/0157152 | A1 | 6/2011 | Byun |
| 2014/0198093 | A1 | 7/2014 | Nambi et al. |
| 2014/0198138 | A1 | 7/2014 | Nambi et al. |
| 2016/0117986 | A1 | 4/2016 | Wang |
| 2017/0116933 | A1 | 4/2017 | Xu |
| 2017/0206851 | A1 | 7/2017 | Sun et al. |

FOREIGN PATENT DOCUMENTS

| | | | |
|---|---|---|---|
| CN | 102110409 | A | 6/2011 |
| CN | 104269155 | A | 1/2015 |
| CN | 104282271 | A | 1/2015 |
| CN | 104835464 | A | 8/2015 |
| CN | 105103214 | A | 11/2015 |
| CN | 105405425 | A | 3/2016 |
| CN | 105469768 | A | 4/2016 |
| CN | 105487631 | A | 4/2016 |
| CN | 105845068 | A | 8/2016 |
| TW | 200811800 | A | 3/2008 |

OTHER PUBLICATIONS

Chinese Office Action corresponding to Chinese Patent Application No. 201710463360.9 (Foreign Text, 9 pages; English Translation, 9 pages) (Mar. 19, 2019).

* cited by examiner

CURRENT COMPARISON CIRCUIT, DISPLAY DEVICE AND DRIVING METHOD THEREOF

CROSS-REFERENCE TO RELATED APPLICATIONS

This application is a 35 U.S.C. 371 national stage application of PCT International Application No. PCT/CN2018/086807 filed on May 15, 2018, which claims the benefit of Chinese Patent Application No. 201710463360.9 filed on Jun. 19, 2017, the disclosures of which are incorporated herein by reference.

TECHNICAL FIELD

The present disclosure relates to the field of display technologies, and more particularly to a current circuit, a display device, and a driving method thereof.

BACKGROUND

Portable electronic devices such as mobile phones have become very common in everyday life. Standby duration is among aspects over which users of the portable electronic devices have concerns. In a scenario of being used drastically (for example, playing a video clip), the portable electronic device has an increased power consumption, meaning that the standby duration will be shortened. Display effects are another aspect over which the users of the portable electronic devices have concerns. In viewing video content, the users expect a smooth picture rendering. This requires a larger refresh rate at which the displayed pictures are refreshed.

SUMMARY

According to an aspect of the present disclosure, a current comparison circuit is provided for use in a display device. The display device is configured to be supplied with a plurality of power supply voltages for powering a digital portion and an analog portion of the display device through respective power supplying paths. The current comparison circuit comprises a plurality of comparator circuits each configured to compare a current on a respective one of the power supplying paths with a respective reference value and to output the respective comparison value. A combination of the respective comparison values output by the comparator circuits is indicative of a type of content being displayed by the display device.

In some embodiments, the plurality of power supply voltages comprises a digital power supply voltage for powering the digital portion of the display device, an analog power supply positive voltage for powering the analog portion of the display device, and an analog power supply negative voltage for powering the analog portion of the display device. The plurality of comparator circuits comprises: a first comparator circuit configured to compare a first current on the power supplying path for the digital power supply voltage with a first reference value; a second comparator circuit configured to compare a second current on the power supplying path for the analog power supply positive voltage with a second reference value; and a third comparator circuit configured to compare a third current on the power supplying path for the analog power supply negative voltage with a third reference value.

In some embodiments, the first comparator circuit comprises: a first comparator having a non-inverting input terminal and an inverting input terminal; and a first resistor, connected between a ground terminal and one of the non-inverting input terminal or the inverting input terminal, for directing the first current to the ground terminal. The other of the non-inverting input terminal or the inverting input terminal is configured to receive a first reference voltage indicative of the first reference value. In some embodiments, the first comparator circuit further comprises a second resistor connected between the ground terminal and the other of the non-inverting input terminal or the inverting input terminal for directing a first reference current to the ground terminal to establish the first reference voltage at the other of the non-inverting input terminal or the inverting input terminal. In some embodiments, the first resistor and the second resistor have equal resistances.

In some embodiments, the second comparator circuit comprises: a second comparator having a non-inverting input terminal and an inverting input terminal; and a third resistor, connected between a ground terminal and one of the non-inverting input terminal or the inverting input terminal, for directing the second current to the ground terminal. The other of the non-inverting input terminal or the inverting input terminal is configured to receive a second reference voltage indicative of the second reference value. In some embodiments, the second comparator circuit further comprises a fourth resistor connected between the ground terminal and the other of the non-inverting input terminal or the inverting input terminal for directing a second reference current to the ground terminal to establish the second reference voltage at the other of the non-inverting input terminal or the inverting input terminal. In some embodiments, the third resistor and the fourth resistor have equal resistances.

In some embodiments, the third comparator circuit comprises: a third comparator having a non-inverting input terminal and an inverting input terminal; and a fifth resistor connected between a ground terminal and one of the non-inverting input terminal or the inverting input terminal for directing the third current to the ground terminal. The other of the non-inverting input terminal or the inverting input terminal is configured to receive a third reference voltage indicative of the third reference value. In some embodiments, the third comparator circuit further comprises a sixth resistor connected between the ground terminal and the other of the non-inverting input terminal or the inverting input terminal for directing a third reference current to the ground terminal to establish the third reference voltage at the other of the non-inverting input terminal or the inverting input terminal. In some embodiments, the fifth resistor and the sixth resistor have equal resistances.

According to another aspect of the present disclosure, a display device is provided comprising: a gate driver configured to sequentially output a plurality of scan signals; a data driver configured to output data signals in synchronization with each of the scan signals; a power source configured to supply a plurality of power supply voltages for powering a digital portion and an analog portion of the display device through respective power supplying paths; the current comparison circuit as described above; and a timing controller configured to control the gate driver and the data driver to operate at different refresh rates in response to different combinations of the respective comparison values output by the comparator circuits.

According to yet another aspect of the present disclosure, a method of driving a display device is provided. The display device comprises a gate driver, a data driver, a power source configured to supply power to a digital portion and an analog portion of the display device through respective power supplying paths, a current comparison circuit, and a timing a controller. The method comprises: comparing, by the current comparison circuit, currents on respective ones of the power supplying paths with respective reference values; outputting, by the current comparison circuit, a plurality of comparison values in response to the comparing; and controlling, by the timing controller, the gate driver and the data driver to operate at different refresh rates in response to different combinations of the comparison values.

These and other aspects of the present disclosure will be apparent from and elucidated with reference to the embodiment(s) described hereinafter.

DETAILED DESCRIPTION

It will be understood that, although the terms first, second, third etc. may be used herein to describe various elements, components, and/or sections, these elements, components, and/or sections should not be limited by these terms. These terms are only used to distinguish one element, component, or section from another. Thus, a first element, component, or section discussed below could be termed a second element, component, or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to", or "coupled to" another element, it can be connected, or coupled to the other element, or intervening elements may be present. In contrast, when an element is referred to as being "directly connected to", or "directly coupled to" another element, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Embodiments of the present disclosure will be further described in detail below with reference to the accompanying drawings.

Figure 1:
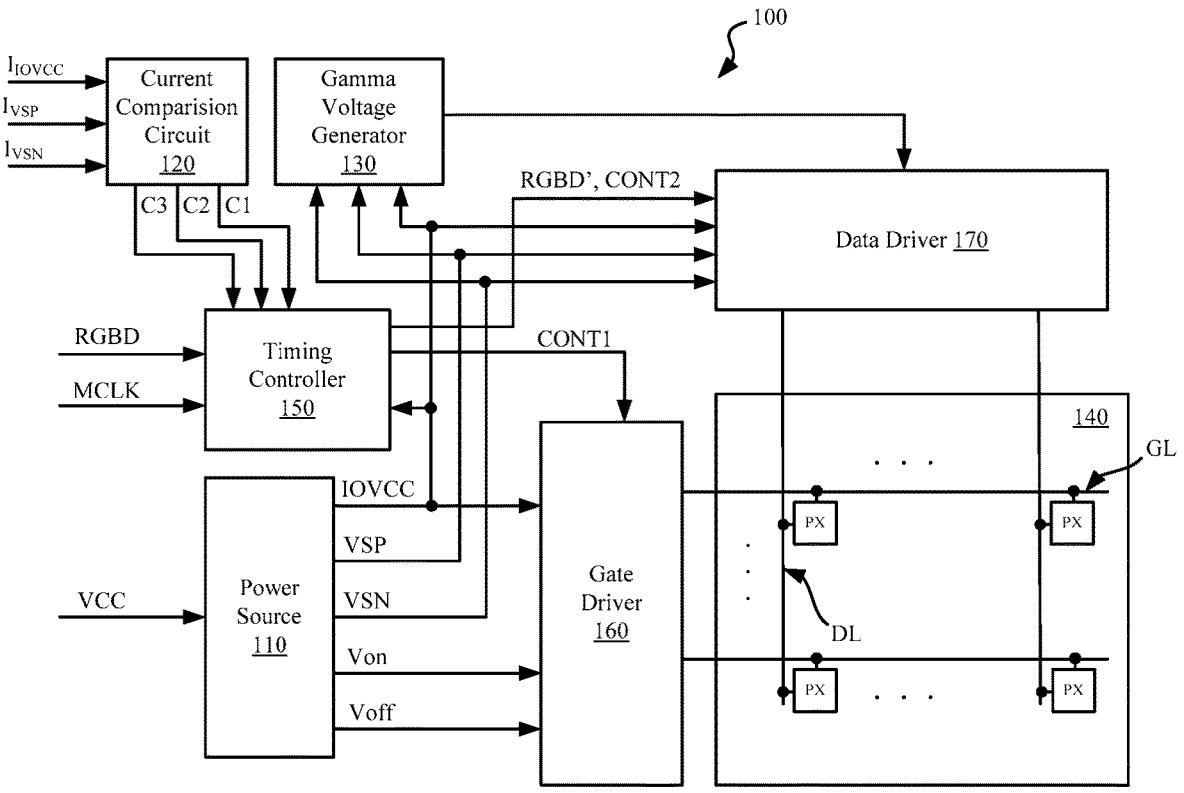
FIG. 1 is a schematic block diagram of a display device according to an embodiment of the present disclosure.

FIG. 1 is a schematic block diagram of a display device 100 according to an embodiment of the present disclosure. The display device 100 includes a power source 110, a current comparison circuit 120, a gamma voltage generator 130, a display panel 140, a timing controller 150, a gate driver 160, and a data driver 170.

A power source 110, such as a DC/DC converter, generates a plurality of power supply voltages from an input voltage VCC. In this example, the power supply voltages include a digital power supply voltage IOVCC, an analog power supply positive voltage VSP, and an analog power supply negative voltage VSN. The digital power supply voltage IOVCC is used to power a digital portion of the display device 100, including, for example, the timing controller 150, the gate driver 160, a portion of the data driver 170, and a portion of the gamma voltage generator 130. Both the analog power supply positive voltage VSP and the analog power supply negative voltage VSN are used to power the analog portion of the display device 100, including, for example, another portion of the data driver 170 and another portion of the gamma voltage generator 130. In this example, the power source 110 further supplies a gate-on voltage Von and a gate-off voltage Voff to the gate driver 160. It will be understood that the power supply voltages listed above are exemplary, and that the power supply 110 can generate other power supply voltages depending on the type of display device 100. For example, the analog power supply positive voltage VSP and the analog power supply negative voltage VSN may not be generated, and instead a single analog power supply voltage AVDD may be generated.

The digital power supply voltage IOVCC, the analog power supply positive voltage VSP, and the analog power supply negative voltage VSN generated by the power source 110 are supplied to the gamma voltage generator 130, the timing controller 150, the gate driver 160, and the data driver 170 via respective power supplying paths (indicated by the arrowed lines in FIG. 1). The load of the power source 110 varies depending on the type of content being displayed by the display panel 140 such that the currents $T_{IOVCC}$, $I_{VSP}$, and $I_{VSN}$ on the respective power supplying paths vary depending on the type of content being displayed. For example, when the display panel 140 is playing dynamic pictures, the power consumption of the data driver 170 is increased, resulting in an increase in the currents $T_{IOVCC}$, $I_{VSP}$, and $I_{VSN}$. When the display panel 140 is playing still pictures, the power consumption of the data driver 170 is reduced, resulting in a decrease in the currents $I_{IOVCC}$, $I_{VSP}$, and $I_{VSN}$. Thus, the magnitudes of the currents $I_{IOVCC}$, $I_{VSP}$, and $I_{VSN}$ can be indicative of the type of content being displayed. Based on this recognition, the concept of the present disclosure has been proposed in which the refresh rate at which the pictures are displayed by the display panel 140 is tuned according to the magnitudes of the currents on the power supplying paths such that the tuned refresh rate is adapted to the type of content being displayed. Tuning of the refresh rate would be advantageous as it allows for reduced power consumption while providing a desired display effect.

The current comparison circuit 120 is provided for comparing the currents on the power supplying paths with respective reference values and outputting a plurality of comparison values, as shown in FIG. 1. In this example, the current comparison circuit 120 outputs comparison values C1, C2, and C3 in response to a comparison between the currents $I_{IOVCC}$, $I_{VSP}$, and $I_{VSN}$ and respective reference values. As explained above, different combinations of the comparison values C1, C2, and C3 may indicate different types of content being displayed. Details of the current comparison circuit 120 will be further described later.

The gamma voltage generator 130 generates as a voltage reference for the data driver 170 a series of gamma voltages. The gamma voltage generator 130 may be implemented by any known or future techniques. In the example shown in FIG. 1, the gamma voltage generator 130 may include a digital circuit portion powered by the digital power supply voltage IOVCC and an analog circuit portion powered by the analog power supply positive voltage VSP and the analog power supply negative voltage VSN.

The display panel 140 includes a plurality of gate lines GL extending in a first direction, a plurality of data lines DL extending in a second direction intersecting the first direction, and a plurality of pixels PX arranged in a matrix. Each of the pixels PX is electrically connected to a corresponding one of the gate lines GL and a corresponding one of the data lines DL.

The timing controller 150 controls the operations of the display panel 140, the gate driver 160, and the data driver 170. The timing controller 150 retrieves input image data RGBD from a memory (not shown). The input image data RGBD includes input pixel data for the plurality of pixels PX, and each of the input pixel data may include red grayscale data R, green grayscale data or blue grayscale data B for a corresponding one of the plurality of pixels PX. The timing controller 150 further receives a main clock signal MCLK from a clock generator or a host controller (not shown), and receives the comparison values C1, C2, and C3 from the current comparison circuit 120. The timing controller 150 generates output image data RGBD', a first control signal CONT1, and a second control signal CONT2 based on the input image data RGBD, the main clock signal MCLK, and the comparison values C1, C2, C3. The output image data RGBD' is supplied to the data driver 170. In some embodiments, the output image data RGBD' may be substantially the same image data as the input image data RGBD. In some embodiments, the output image data RGBD' may be compensated image data generated by compensating the input image data RGBD. The first control signal CONT1 is supplied to the gate driver 160, and the driving timing of the gate driver 160 can be controlled based on the first control signal CONT1. The second control signal CONT2 is supplied to the data driver 170, and the driving timing of the data driver 170 can be controlled based on the second control signal CONT2.

The gate driver 160 receives the first control signal CONT1 from the timing controller 150. The gate driver 160 is configured to sequentially output a plurality of scan signals to the gate lines GL based on the first control signal CONT1. In some embodiments, the gate driver 160 may be integrated in the display panel 140. Alternatively, the gate driver 160 may be connected to the display panel 140 by, for example, a Tape Carrier Package (TCP).

The data driver 170 receives the second control signal CONT2 and the output image data RGBD' from the timing controller 150. The data driver 170 is configured to generate a plurality of data signals based on the second control signal CONT2 and the output image data RGBD'. The data driver 170 is also configured to output the plurality of data signals to the data lines DL in synchronization with each of the scan signals output from the gate driver 160. In the example shown in FIG. 1, the data driver 170 may include a digital circuit portion powered by the digital power supply voltage IOVCC and an analog circuit portion powered by the analog power supply positive voltage VSP and the analog power supply negative voltage VSN. For example, the data driver 170 may include a shift register, a latch, a digital-to-analog converter, and a buffer. The shift register outputs a latch pulse to the latch. The latch temporarily stores and outputs the output image data RGBD' to the digital-to-analog converter. The digital-to-analog converter generates analog data signals based on the output image data RGBD' from the timing controller 150 and the gamma voltages from the gamma voltage generator 130, and outputs the analog data signals to the buffer. The buffer outputs the analog data signals to the data lines DL.

Figure 2:
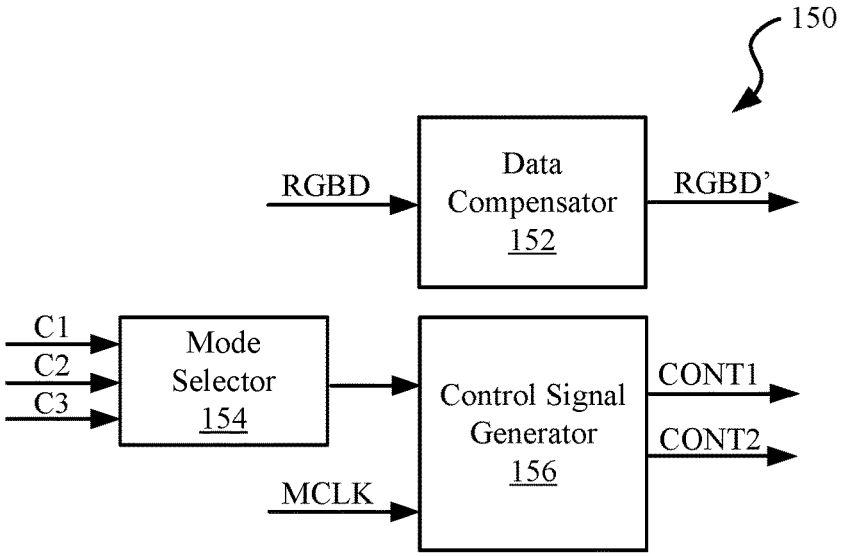
FIG. 2 is a schematic block diagram of a timing controller included in the display device shown in FIG. 1.

FIG. 2 is a schematic block diagram of a timing controller 150 included in the display device 100 shown in FIG. 1. Referring to FIG. 2, the timing controller 150 includes a data compensator 152, a mode selector 154, and a control signal generator 156. For convenience of description, the timing controller 150 is illustrated in FIG. 2 as being divided into three elements, although the timing controller 150 may not be physically divided.

The data compensator 152 receives the input image data RGBD and can generate the output image data RGBD' by selectively compensating the input image data RGBD. For example, the data compensator 152 can selectively perform image quality compensation, point compensation, adaptive color correction (ACC), and/or dynamic capacitance compensation (DCC) for the input image data RGBD to generate the output image data RGBD'. In some embodiments, the data compensator 152 may include a single line memory that stores pixel data corresponding to a single row of pixels. The data compensator 152 may be optional.

The mode selector 154 receives the comparison values C1, C2, and C3 from the current comparison circuit 120. As described earlier, the combination of the comparison values C1, C2, and C3 may indicate the type of content being displayed. In response to different combinations of the comparison values C1, C2, and C3, the mode selector 154 determines different operating modes to adjust the refresh rate at which the displayed pictures are refreshed. Specifically, the mode selector 154 can select an appropriate clock frequency (e.g., a pixel clock frequency) and generate the required time parameters (e.g., a horizontal scan period, a horizontal blanking duration, a vertical blanking duration, etc.). In some embodiments, the adjustment of the refresh rate can be implemented using the mechanisms described in Chinese Patent Application Publication No. CN 106205460 A, the entire disclosure of which is incorporated herein by reference. In other embodiments, any other suitable mechanism can be used.

The control signal generator 156 generates the first control signal CONT1 for the gate driver 160 of FIG. 1 and the second control signal CONT2 for the data driver 170 of FIG. 1 based on the time parameters generated by the mode selector 154 and the received main clock signal MCLK. In some embodiments, the first control signal CONT1 may include a vertical enable signal, a gate clock signal, etc., and the second control signal CONT2 may include a horizontal enable signal, a data clock signal, a data load signal, a polarity control signal, and the like. It will be appreciated that the first and second control signals CONT1, CONT2 may take different forms depending on the type of display device 100.

The timing controller 150 can be implemented in a number of ways, such as in dedicated hardware, to perform the various functions discussed herein. A "processor" is an example of the timing controller 150 that employs one or more microprocessors that can be programmed using software (e.g., microcode) to perform the various functions discussed herein. The timing controller 150 can be implemented with or without a processor, and can also be implemented as a combination of dedicated hardware that performs some functions and a processor that performs other functions (e.g., one or more programmed microprocessors and associated circuits). Examples of controller components that may be employed in various embodiments of the present disclosure include, but are not limited to, conventional microprocessors, application specific integrated circuits (ASICs), and field programmable gate arrays (FPGAs).

Figure 3:
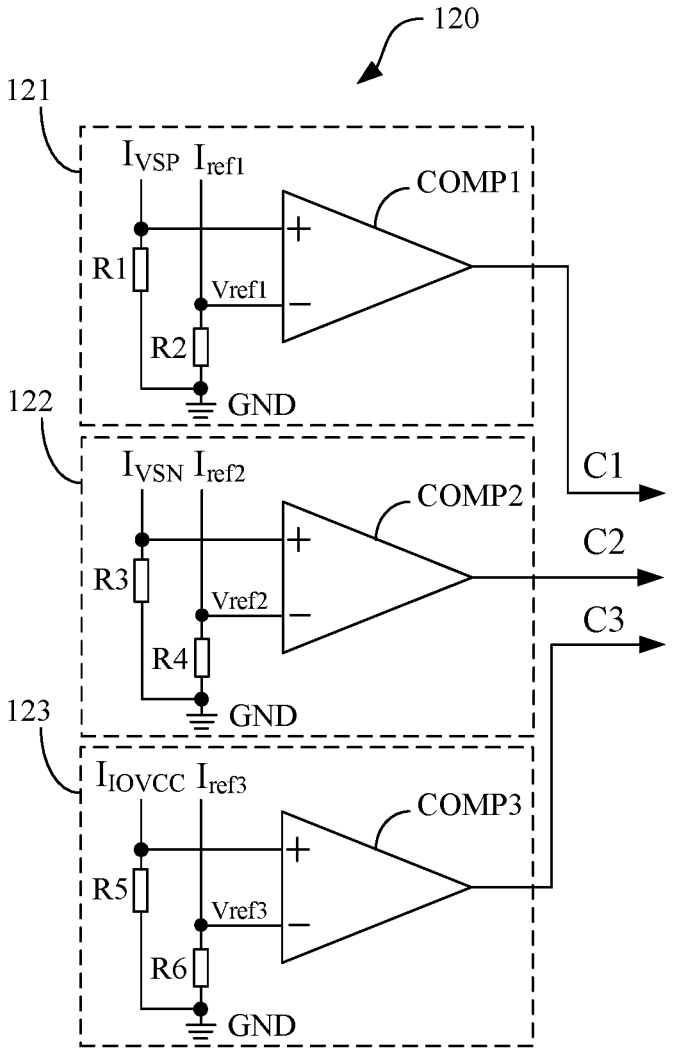
FIG. 3 is a schematic diagram of a current comparison circuit according to an embodiment of the present disclosure.

FIG. 3 shows in more detail the current comparison circuit 120 according to an embodiment of the present disclosure. Referring to FIG. 3, the current comparison circuit 120 includes a plurality of comparator circuits 121, 122, 123. It will be understood that although three comparator circuits are shown in FIG. 3, the current comparison circuit 120 may include more or fewer comparator circuits in other embodiments.

Each of the comparator circuits 121, 122, 123 is configured to compare the current on a respective one of the power supplying paths with a respective reference value and output the respective comparison value. In this example, the comparator circuits 121, 122, and 123 compare the currents $I_{VSP}$, $I_{VSN}$, and $I_{IOVCC}$ with respective reference values and output the comparison values C1, C2, and C3, respectively. Specifically, the first comparator circuit 121 is configured to compare the first current $I_{VSP}$ with a first reference value and output the comparison value C1, the second comparator circuit 122 is configured to compare the second current $I_{VSN}$ with a second reference value and output the comparison value C2, and the third comparator circuit is configured to compare the third current $I_{IOVCC}$ with a third reference value and output the comparison value C3. As previously mentioned, a particular combination of the comparison values C1, C2, and C3 indicates a particular type of content being displayed. It will be appreciated that the first, second and third reference values may be selected appropriately such that different combinations of the comparison values C1, C2 and C3 are capable of indicating different typical types of content being displayed.

Figure 4:
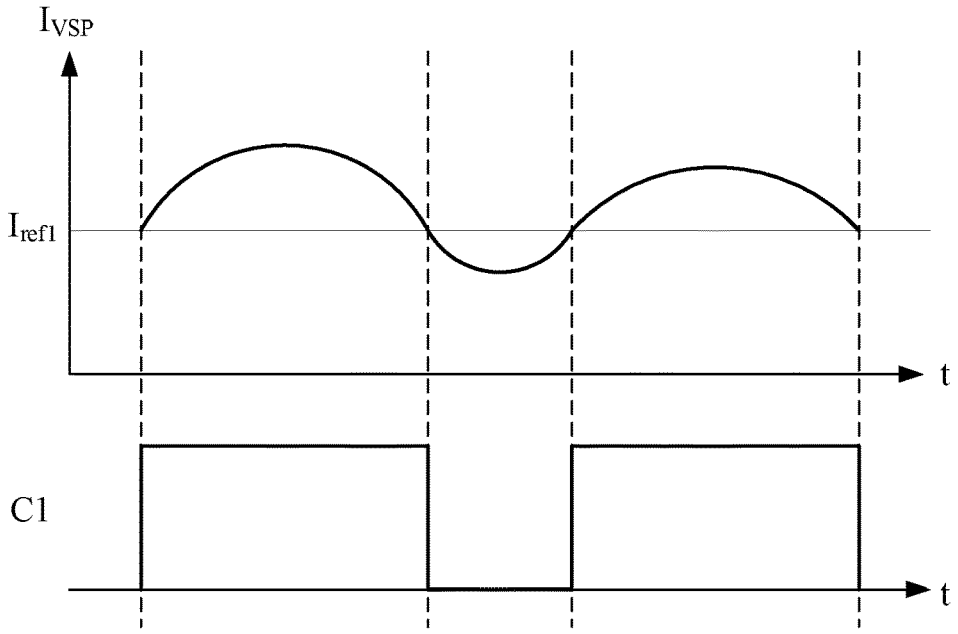
FIG. 4 is a schematic diagram showing a transfer characteristic of the first comparator circuit shown in FIG. 3.

The first comparator circuit 121 includes a first comparator COMP1 and a first resistor R1. The first comparator COMP1 has a non-inverting input terminal indicated by "+" and an inverting input terminal indicated by "−". The first resistor R1 is connected between the ground GND and the non-inverting input terminal "+" for directing the first current $I_{VSP}$ to the ground GND. This establishes at the non-inverting input terminal "+" a voltage determined by the first current $I_{VSP}$ and the first resistor R1. The inverting input terminal "−" is configured to receive a first reference voltage $V_{ref1}$ indicative of the first reference value. In the example shown in FIG. 3, the first comparator circuit 121 further includes a second resistor R2 connected between the ground GND and the inverting input terminal "−" for directing the first reference current $I_{ref1}$ to the ground GND to establish the first reference voltage $V_{ref1}$ at the inverting input terminal "−". In the case where the first resistor R1 and the second resistor R2 have equal resistances, the first reference value with which the first current IVSP is compared is equal to the magnitude of the first reference current $I_{ref1}$. In this case, when $I_{VSP}>I_{ref1}$, the comparison value C1 output by the first comparator COMP1 is at a high level, and when $I_{VSP}<I_{ref1}$, the comparison value C1 output by the first comparator COMP1 is at a low level. Such a transfer characteristic of the first comparator circuit 121 is shown intuitively in FIG. 4.

In some embodiments, the first reference voltage $V_{ref1}$ may be supplied by, for example, a separate voltage generator, and thus the first reference current $I_{ref1}$ and the second resistor R2 are not necessary. It will also be understood that in some embodiments, the voltage established by the first current $I_{VSP}$ and the first resistor R1 may be applied to the inverting input terminal "−" of the first comparator COMP1, and the first reference voltage $v_{ref1}$ may be applied to the non-inverting input terminal "+" of the first comparator COMP1. This results in a transfer characteristic that is "flipped" compared to the transfer characteristic shown in FIG. 4. That is, when $I_{VSP}>I_{ref1}$, the comparison value C1 is low, and when $I_{VSP}<I_{ref1}$, the comparison value C1 is high.

Similarly, the second comparator circuit 122 includes a second comparator COMP2 and a third resistor R3. The second comparator COMP2 has a non-inverting input terminal indicated by "+" and an inverting input terminal indicated by "−". The third resistor R3 is connected between the ground GND and the non-inverting input terminal "+" for directing the second current $I_{VSN}$ to the ground GND. This establishes at the non-inverting input terminal "+" a voltage determined by the second current $I_{VSN}$ and the third resistor R3. The inverting input terminal "−" is configured to receive a second reference voltage $V_{ref2}$ indicative of the second reference value. In the example shown in FIG. 3, the second comparator circuit 122 further includes a fourth resistor R4 connected between the ground GND and the inverting input terminal "−" for directing the second reference current $I_{ref2}$ to the ground GND to establish the second reference voltage Vref2 at the inverting input terminal "−". In the case where the third resistor R3 and the fourth resistor R4 have equal resistances, the second reference value with which the second current $I_{VSN}$ is compared is equal to the magnitude of the second reference current Iref2. In this case, when $I_{VSN}>I_{ref2}$, the comparison value C2 output by the second comparator COMP2 is at a high level, and when $I_{VSN}<I_{ref2}$, the comparison value C2 output by the second comparator COMP2 is at a low level.

In some embodiments, the second reference voltage $V_{ref2}$ may be supplied by, for example, a separate voltage generator, and thus the second reference current $I_{ref2}$ and the fourth resistor R4 are not necessary. It will also be understood that in some embodiments, the voltage established by the second current $I_{VSN}$ and the third resistor R3 may be applied to the inverting input terminal "−" of the second comparator COMP2, and the second reference voltage $V_{ref2}$ may be applied to the non-inverting input terminal "+" of the second comparator COMP2.

Similarly, the third comparator circuit 123 includes a third comparator COMP3 and a fifth resistor R5. The third comparator COMP3 has a non-inverting input terminal indicated by "+" and an inverting input terminal indicated by "−". The fifth resistor R5 is connected between the ground GND and the non-inverting input terminal "+" for directing the third current $I_{IOVCC}$ to the ground GND. This establishes at the non-inverting input terminal "+" a voltage determined by the third current $I_{IOVCC}$ and the fifth resistor R5. The inverting input terminal "−" is configured to receive a third reference voltage $V_{ref3}$ indicative of the third reference value. In the example shown in FIG. 3, the third comparator circuit 123 further includes a sixth resistor R6 connected between the ground GND and the inverting input terminal "–" for directing the third reference current $I_{ref3}$ to the ground GND to establish the third reference voltage $V_{ref3}$ at the inverting input terminal "–". In the case where the fifth resistor R5 and the sixth resistor R6 have equal resistances, the third reference value with which the third current $I_{IOVCC}$ is compared is equal to the magnitude of the second reference current $I_{ref3}$. In this case, when $I_{IOVCC}>I_{ref3}$, the comparison value C3 output by the third comparator COMP3 is at a high level, and when $I_{IOVCC}<I_{ref3}$, the comparison value C3 output by the third comparator COMP3 is at a low level.

In some embodiments, the third reference voltage $V_{ref3}$ may be supplied by, for example, a separate voltage generator, and thus the third reference current Iref3 and the sixth resistor R6 are not necessary. It will also be understood that in some embodiments, the voltage established by the third current $I_{IOVCC}$ and the sixth resistor R6 may be applied to the inverting input terminal "–" of the third comparator COMP3, and the third reference voltage $V_{ref3}$ may It is applied to the non-inverting input terminal "+" of the third comparator COMP3.

Continuing with the example of FIG. 3, the comparison values C1, C2, and C3 may be provided to the timing controller 120 (FIG. 2) for adjusting the refresh rate at which the displayed pictures are refreshed. These three comparison values have eight different combinations that can indicate eight different types of content being displayed. Different refresh rates can be used for different content types to reduce power consumption while providing the desired display effect. Specifically, a high refresh rate can be employed for content that requires a high display effect, and a low refresh rate can be employed for content that requires a low display effect. An example of the correspondence between the comparison values and the refresh rate is shown in Table 1.

TABLE 1

| Comparison value | | | |
|---|---|---|---|
| C1 | C2 | C3 | refresh rate (Hz) |
| 0 | 0 | 0 | 30 |
| 0 | 0 | 1 | 40 |
| 0 | 1 | 0 | 50 |
| 0 | 1 | 1 | 60 |
| 1 | 0 | 0 | 70 |
| 1 | 0 | 1 | 80 |
| 1 | 1 | 0 | 90 |
| 1 | 1 | 1 | 100 |

Figure 5:
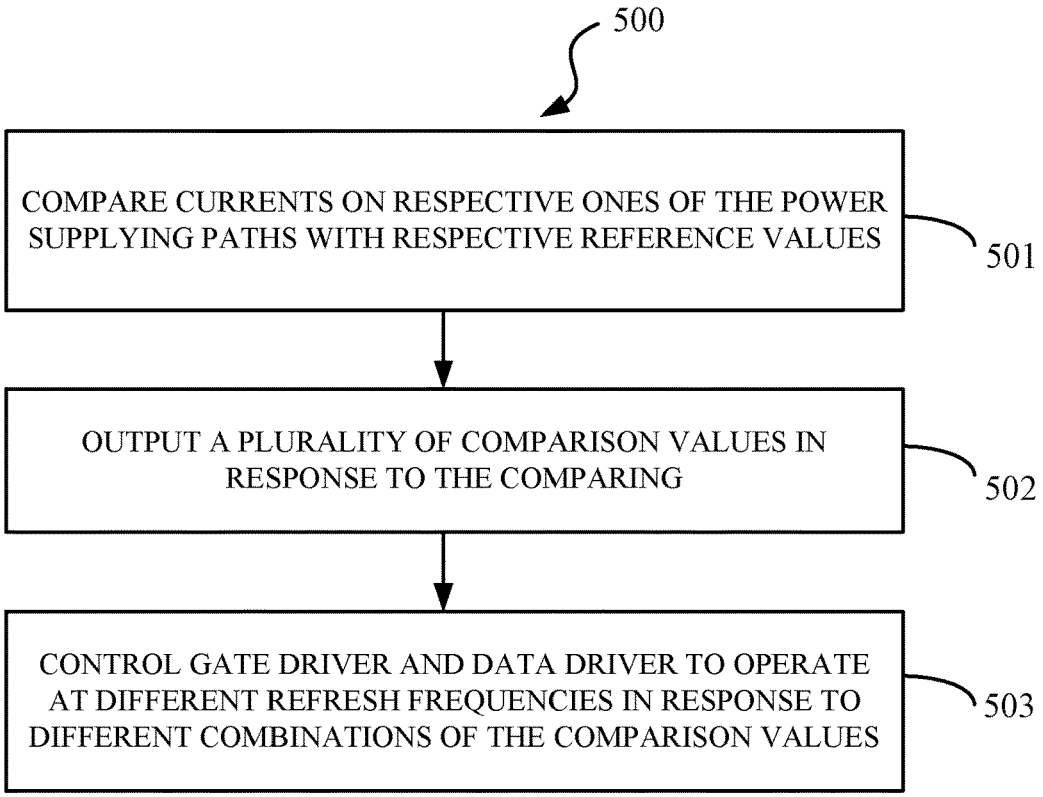
FIG. 5 is a flow chart of a method of driving a display device according to an embodiment of the present disclosure.

FIG. 5 is a flow chart of a method 500 of driving a display device according to an embodiment of the present disclosure. The display device may take the form of the display device 100 described above with respect to FIG. 1. Specifically, the display device 100 includes a power source 110, a current comparison circuit 120, a timing controller 150, a gate driver 160, and a data driver 170.

At step 501, the current comparison circuit 120 compares the currents on respective ones of the power supplying paths with respective reference values. At step 502, the current comparison circuit 120 outputs a plurality of comparison values in response to the comparison. At step 503, in response to different combinations of the comparison values, the timing controller 150 controls the gate driver 160 and the data driver 170 to operate at different refresh rates.

The method 500 can provide the same advantages as the display device embodiments described above, which are not repeated here.

Various modifications and variations can be made by a person skilled in the art to the disclosed embodiments without departing from the scope of the present disclosure. Thus, if such modifications and variations fall within the scope of the appended claims and equivalents thereof, they are intended to be encompassed in the present disclosure.

What is claimed is:

1. A current comparison circuit for a display device, the display device configured to be supplied with a plurality of power supply voltages for powering a digital portion and an analog portion of the display device through respective power supplying paths, the current comparison circuit comprising:

a plurality of comparator circuits, each configured to compare a respective current on a respective one of the power supplying paths with a respective reference value and to output a respective comparison value, wherein a combination of the respective comparison values output by the plurality of comparator circuits is indicative of a type of content being displayed by the display device.

2. The current comparison circuit of claim 1, wherein the plurality of power supply voltages comprises a digital power supply voltage for powering the digital portion of the display device, an analog power supply positive voltage for powering the analog portion of the display device, and an analog power supply negative voltage for powering the analog portion of the display device, and wherein the plurality of comparator circuits comprises:

a first comparator circuit configured to compare the respective current comprising a first current on the respective one of the power supplying paths for the digital power supply voltage with the respective reference value comprising a first reference value;

a second comparator circuit configured to compare the respective current comprising a second current on the respective one of the power supplying paths for the analog power supply positive voltage with the respective reference value comprising a second reference value; and a third comparator circuit configured to compare the respective current comprising a third current on the respective one of the power supplying paths for the analog power supply negative voltage with the respective reference value comprising a third reference value.

3. The current comparison circuit of claim 2, wherein the first comparator circuit comprises:

a first comparator having a non-inverting input terminal and an inverting input terminal; and a first resistor, connected between a ground terminal and one of the non-inverting input terminal or the inverting input terminal, that is configured to direct the first current to the ground terminal, and wherein the other of the non-inverting input terminal or the inverting input terminal is configured to receive a first reference voltage indicative of the first reference value.

4. The current comparison circuit of claim 3, wherein the first comparator circuit further comprises a second resistor connected between the ground terminal and the other of the non-inverting input terminal or the inverting input terminal and configured to direct a first reference current to the ground terminal to establish the first reference voltage at the other of the non-inverting input terminal or the inverting input terminal.

5. The current comparison circuit of claim 4, wherein the first resistor and the second resistor have equal resistances.

6. The current comparison circuit of claim 2, wherein the second comparator circuit comprises:

a second comparator having a non-inverting input terminal and an inverting input terminal; and a third resistor, connected between a ground terminal and one of the non-inverting input terminal or the inverting input terminal, that is configured to direct the second current to the ground terminal, and wherein the other of the non-inverting input terminal or the inverting input terminal is configured to receive a second reference voltage indicative of the second reference value.

7. The current comparison circuit of claim 6, wherein the second comparator circuit further comprises a fourth resistor connected between the ground terminal and the other of the non-inverting input terminal or the inverting input terminal and configured to direct a second reference current to the ground terminal to establish the second reference voltage at the other of the non-inverting input terminal or the inverting input terminal.

8. The current comparison circuit of claim 7, wherein the third resistor and the fourth resistor have equal resistances.

9. The current comparison circuit of claim 2, wherein the third comparator circuit comprises:

a third comparator having a non-inverting input terminal and an inverting input terminal; and a fifth resistor, connected between a ground terminal and one of the non-inverting input terminal or the inverting input terminal, that is configured to direct the third current to the ground terminal, and wherein the other of the non-inverting input terminal or the inverting input terminal is configured to receive a third reference voltage indicative of the third reference value.

10. The current comparison circuit of claim 9, wherein the third comparator circuit further comprises a sixth resistor connected between the ground terminal and the other of the non-inverting input terminal or the inverting input terminal and configured to direct a third reference current to the ground terminal to establish the third reference voltage at the other of the non-inverting input terminal or the inverting input terminal.

11. The current comparison circuit of claim 10, wherein the fifth resistor and the sixth resistor have equal resistances.

12. A display device comprising:

a gate driver configured to sequentially output a plurality of scan signals;

a data driver configured to output data signals in synchronization with each of the scan signals;

a power source configured to supply a plurality of power supply voltages for powering a digital portion and an analog portion of the display device through respective power supplying paths;

a current comparison circuit comprising a plurality of comparator circuits, each configured to compare a respective current on a respective one of the power supplying paths with a respective reference value and to output a respective comparison value, wherein a combination of the respective comparison values output by the plurality of comparator circuits is indicative of a type of content being displayed by the display device; and a timing controller configured to control the gate driver and the data driver to operate at different refresh rates in response to different combinations of the respective comparison values output by the comparator circuits.

13. A method of driving a display device, the display device comprising a gate driver, a data driver, a power source configured to supply power to a digital portion and an analog portion of the display device through respective power supplying paths, a current comparison circuit, and a timing controller, the method comprising:

comparing, by the current comparison circuit, currents on respective ones of the power supplying paths with respective reference values;

outputting, by the current comparison circuit, respective comparison values in response to the comparing; and controlling, by the timing controller, the gate driver and the data driver to operate at different refresh rates in response to different combinations of the respective comparison values.

14. The display device of claim 12, wherein the plurality of power supply voltages comprises a digital power supply voltage for powering the digital portion of the display device, an analog power supply positive voltage for powering the analog portion of the display device, and an analog power supply negative voltage for powering the analog portion of the display device, and wherein the plurality of comparator circuits comprises:

a first comparator circuit configured to compare the respective current comprising a first current on the respective one of the power supplying paths for the digital power supply voltage with the respective reference value comprising a first reference value;

a second comparator circuit configured to compare the respective current comprising a second current on the respective one of the power supplying paths for the analog power supply positive voltage with the respective reference value comprising a second reference value; and a third comparator circuit configured to compare the respective current comprising a third current on the respective one of the power supplying paths for the analog power supply negative voltage with the respective reference value comprising a third reference value.

15. The display device of claim 14, wherein the first comparator circuit comprises:

a first comparator having a non-inverting input terminal and an inverting input terminal; and a first resistor, connected between a ground terminal and one of the non-inverting input terminal or the inverting input terminal, that is configured to direct the first current to the ground terminal, and wherein the other of the non-inverting input terminal or the inverting input terminal is configured to receive a first reference voltage indicative of the first reference value.

16. The display device of claim 15, wherein the first comparator circuit further comprises a second resistor connected between the ground terminal and the other of the non-inverting input terminal or the inverting input terminal and configured to direct a first reference current to the ground terminal to establish the first reference voltage at the other of the non-inverting input terminal or the inverting input terminal.

17. The display device of claim 14, wherein the second comparator circuit comprises:

a second comparator having a non-inverting input terminal and an inverting input terminal; and a third resistor, connected between a ground terminal and one of the non-inverting input terminal or the inverting input terminal, that is configured to direct the second current to the ground terminal, and wherein the other of the non-inverting input terminal or the inverting input terminal is configured to receive a second reference voltage indicative of the second reference value.

18. The display device of claim 17, wherein the second comparator circuit further comprises a fourth resistor connected between the ground terminal and the other of the non-inverting input terminal or the inverting input terminal and configured to direct a second reference current to the ground terminal to establish the second reference voltage at the other of the non-inverting input terminal or the inverting input terminal.

19. The display device of claim 14, wherein the third comparator circuit comprises:

a third comparator having a non-inverting input terminal and an inverting input terminal; and a fifth resistor, connected between a ground terminal and one of the non-inverting input terminal or the inverting input terminal, that is configured to direct the third current to the ground terminal, and wherein the other of the non-inverting input terminal or the inverting input terminal is configured to receive a third reference voltage indicative of the third reference value.

20. The display device of claim 19, wherein the third comparator circuit further comprises a sixth resistor connected between the ground terminal and the other of the non-inverting input terminal or the inverting input terminal and configured to direct a third reference current to the ground terminal to establish the third reference voltage at the other of the non-inverting input terminal or the inverting input terminal.

* * * * *